US006578227B2

(12) United States Patent
Bailey

(10) Patent No.: US 6,578,227 B2
(45) Date of Patent: Jun. 17, 2003

(54) PAD FOR USE IN A CRITICAL ENVIRONMENT

(75) Inventor: Harald A. Bailey, Alamo, CA (US)

(73) Assignee: Berkshire Corporation, Great Barrington, MA (US)

( * ) Notice: Subject to any disclaimer, the term of this patent is extended or adjusted under 35 U.S.C. 154(b) by 93 days.

(21) Appl. No.: 09/805,710

(22) Filed: Mar. 13, 2001

(65) Prior Publication Data

US 2002/0129834 A1 Sep. 19, 2002

(51) Int. Cl.[7] ..... B08B 11/00

(52) U.S. Cl. ..... 15/102; 15/88.3; 15/230.16; 15/244.1; 492/30; 492/37

(58) Field of Search ..... 15/102, 88.3, 230, 15/230.16, 244.1; D32/50; 492/30, 37, 36

(56) References Cited

U.S. PATENT DOCUMENTS

| | | | | |
|---|---|---|---|---|
| 2,287,768 | A | * | 6/1942 | Eckstein |
| 4,566,911 | A | | 1/1986 | Tomita et al. |
| 5,311,634 | A | | 5/1994 | Andros |
| 5,460,655 | A | | 10/1995 | Pisacane et al. |
| 5,778,481 | A | | 7/1998 | Amsden et al. |
| 5,966,766 | A | | 10/1999 | Shipley et al. |
| 6,004,402 | A | | 12/1999 | Cercone et al. |
| 6,004,640 | A | | 12/1999 | Pisacane et al. |
| D430,716 | S | * | 9/2000 | Denney |
| D431,100 | S | * | 9/2000 | Denney |

FOREIGN PATENT DOCUMENTS

| | | | |
|---|---|---|---|
| AU | 227840 | * | 4/1960 |

* cited by examiner

*Primary Examiner*—Randall E. Chin
(74) *Attorney, Agent, or Firm*—McCormick, Paulding & Huber LLP

(57) ABSTRACT

A cleaning/polishing pad has a first surface with raised, substantially nubs, having a length greater than a width, arranged adjacent each other forming laterally alternating rows of nubs and having troughs interspersed therebetween, a second surface opposite the first surface, and a thickness. The troughs, which may contain polishing/cleaning chemicals, are divided into first and second groups of substantially parallel troughs. The groups of troughs are arranged at an angle to one another forming a hatch pattern. The pad can be formed to make roller brushes, circular brushes or manual wipes. For the circular brushes the nubs are arranged adjacent each other forming laterally alternating concentric circles of nubs. Micropores are interspersed within the pad having a gradient of pores with smaller pores towards the first surface and larger pores towards the second. There are no sharp edges or corners in/on the pad.

11 Claims, 3 Drawing Sheets

PAD FOR USE IN A CRITICAL ENVIRONMENT

FIELD OF THE INVENTION

The present invention generally relates to cleaning and polishing devices for use in critical environments, and in particular, to a cleaning/polishing pad which has a selected surface pattern for use as a circular or roller brush and as a manual wipe, and a method for using the pad.

BACKGROUND OF THE INVENTION

Many industrial operations, especially in semiconductor manufacturing operations, require efficient means to polish and clean highly finished surfaces. Semiconductor materials, such as silicon wafers, require the removal of particulates and other surface contaminants during the manufacturing processes. Other materials, such as optical glass or magnetic storage devices, also require similar removal of particulates and other surface contaminants. In particular, operations in semiconductor device fabrication often utilize a two-step process that includes a polishing step followed by a brushing step. One of the main goals of the polishing step is to planarize the wafer, while the main goal of the brushing step is to perform subsequent cleaning of the wafer. These two-steps are often repeated followed by the addition of semiconductor material in order to manufacture a semiconductor material having multiple polished layers. It is essential that particulates and surface contaminates be removed between the layers to avoid defects in the final product.

In the manufacturing of integrated circuits, chemical mechanical polishing has emerged as the preferred approach to achieve both local and global planarization. These techniques typically use a polishing pad along with a polishing slurry. The brushing step, which follows chemical mechanical polishing, typically involves cleaning fluid and a brush device having a sponge-type cleaning pad.

Popular brushes, rollers, sponges and other wiping products made from non-woven, woven or knit materials, typically used in industrial and critical environments, are inadequate to address the higher levels of cleanliness and absorbency required in cleaner environments. Unfortunately, fiber particulates and certain free polymers found on conventional wiping products, frequently contaminate the processes, tools and facilities. In addition to the surface of the manufactured item, the environment and work surfaces in microelectronic firms are susceptible to such contamination. Prior art wipes, sponges or brushes, which have conventional nubs, damage surface features and are very poor at delivering cleaning chemicals to the surface of wafers and other media. Other prior art wipes, sponges or brushes contain chloride and other biocides which are corrosive to disk media surfaces. Also, undesirable metallization of semiconductor wafers might occur when metal particulates are produced by conventional wiping products. Furthermore, silicone has also been used when cleaning, but is not permitted with semiconductor wafers as it is detrimental to the surface of the wafers. Therefore, silicone is not permitted in any product used in the cleaning process.

One method for cleaning wafers involves pads that contact and clean the wafer as they rotate. U.S. Pat. No. 5,778,481 ('481), assigned to International Business Machines Corporation, describes disc shaped cleaning/polishing pads having resilient members (nubs) arranged in patterns (spiral, swirl, concentric or the like) which facilitate the movement of cleaning/polishing fluids from the center of the pads to the periphery. The pads of the '481 patent may be composed of suitable materials such as polyurethane or polyvinyl alcohol.

Likewise, U.S. Pat. No. 5,311,634, issued to Nicholas Andros, describes disc shaped cleaning pads for use on a cleaning apparatus, which consist of a supporting core with a sponge affixed thereto which is a microporous hydroxylated polymer material; the surface of the sponge is convex having a plurality of projections which are preferably a plurality of hemispherical nubs arranged in concentric circles, which may also be ellipsoid, cubic, conical or a variety of other shapes, radiating from the central axis of the sponge.

Furthermore, U.S. Pat. No. 5,966,766, assigned to Advanced Micro Devices, Inc., shows a method and apparatus for cleaning a semiconductor wafer that includes a disc-shaped brush which is a substantially flexible material having a plurality of protrusions thereon; the protrusions are designed to extend through corresponding openings in a disc shaped base wherein the protrusions are spaced apart.

Alternative methods involve the use of sponge or sponge-like rollers for automated machinery, and wipes to manually clean surfaces. U.S. Pat. Nos. 6,004,640 and 5,460,655, assigned to Wilshire Technologies, Inc., disclose a hydrophilic foam article and surface-cleaning method for a clean room which article is made from an open cell, static-dissipative, polyurethane foam and laundered in deionized water, and can be fashioned as a wiper, a sponge, a roller, a swab mounted on a handle, or a plug having a generally cylindrical shape.

Also, U.S. Pat. No. 6,004,402 ('402), assigned to Xomed Surgical Products, Inc., shows a method of cleaning silicon material with a sponge in which the sponge is purified to remove undesirable residual contaminants. The sponge of the '402 patent has 100% open pores and no dead ends or fibrils. Furthermore, the sponge therein also has conical projections extending from the outer surface. The projections are disposed at regular intervals in rows offset from one another in the direction of the longitudinal axis, and have planar surfaces, which are smaller than their bases.

U.S. Pat. No. 4,566,911 ('911), assigned to Kanebo Limited, describes a method for cleaning an article using a cleaning roll having a surface layer of polyvinyl acetal porous elastic material. The roller of the '911 patent may have a smooth surface, a gear-like surface with parallel groves which may form an angle to a roll axis, or projections extending from the surface in which the projections may be circular, ellipsoidal, rectangular, or diamond shape or the like which covers a surface area of 15% to 65% of the entire surface area. The articles of the '911 patent is not designed for use in a critical environment.

None of the above inventions and patents, taken either singularly or in combination, is seen to describe the instant invention as claimed.

SUMMARY OF THE INVENTION

Cleaning pads of the present invention may be used in brushes which are used in chemical mechanical planarization washing, wet bench photoresist, etching techniques, spin drying, disk media washing, substrate washing, and other microelectronic/optical washing and drying processes. Alternatively, the cleaning pads may be used as manual abrasive and wiping pads which are used to apply or remove cleaning chemicals, debris, residues and particles, and to dry surfaces by hand. The cleaning pads facilitate the application of cleaning/polishing chemicals via external delivery, internal delivery, and submerged into the cleaning chemicals.

It is an object of the present invention to provide a cleaning pad surface which generates turbulence in the fluid cleaning chemicals as the pad is moved across a substrate. The cleaning pad of the present invention has at least one surface designed to contact the item to be cleaned. This surface has evenly distributed nubs with troughs interspersed between the nubs. When properly used, the nubs agitate the fluid cleaning chemicals creating sufficient agitation to remove particulates from the item.

A further object of the present invention is to provide a cleaning pad which permits fluid to be dispersed through the pad or to wick into the pad. The present pad has a micropore structure which is open-celled having very fine pores on the order of 2–5 microns. These pores permit the cleaning fluid to be dispersed and removed through the pad. This attribute permits control of the amount of cleaning chemicals present.

Another object of the present invention is to increase the absorbency of cleaning pads or wipes for clean environments. The absorbency of a cleaning pad according to the present invention may be selectively controlled with automated systems. Otherwise, the cleaning pads according to the present invention are highly absorbent.

Yet another object is to control the delivery of cleaning chemicals. The open-cell core of the pad permits even flow of cleaning chemicals, which flow can be modulated by applying a vacuum or pressure across the opposing side of the pad. The present invention facilitates delivery of cleaning chemicals continuously on and into the face of the wafer with higher rates of turbulence and greater flushing and drawing of debris, residues and particles than prior art articles.

A further object of the present invention is to improve the longevity of cleaning pads as long-term disposables. The pads of the current invention have a longer life than prior art cleaning wipes/sponges but are still disposable. The prior art devices have sharp or squared edges which catch on rough substrates resulting in torn wipes or sponges. The pads of the present invention have no sharp or squared edges, and therefore do not tear easily.

Another object of the present invention is to eliminate fiber release from fiber based wiping materials. The uniformity of cells prevents dry spots which might otherwise result in subsequent abrasion that shortens the life of the brush. Also, uniformity limits the transmission of brush particles to the wafer.

It is also an object of the present invention to reduce damage to the item cleaned. Sharp edges are avoided in the present invention, as previously mentioned, which reduces scratching of the item cleaned. Prior art articles have sharp edges which are especially undesirable in the manufacture of semiconductor materials, especially silicon wafers. The nubs on the cleaning pads of the present invention have rounded edges and corners thus eliminating this potential source of scratches.

These and other objects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figure 1:
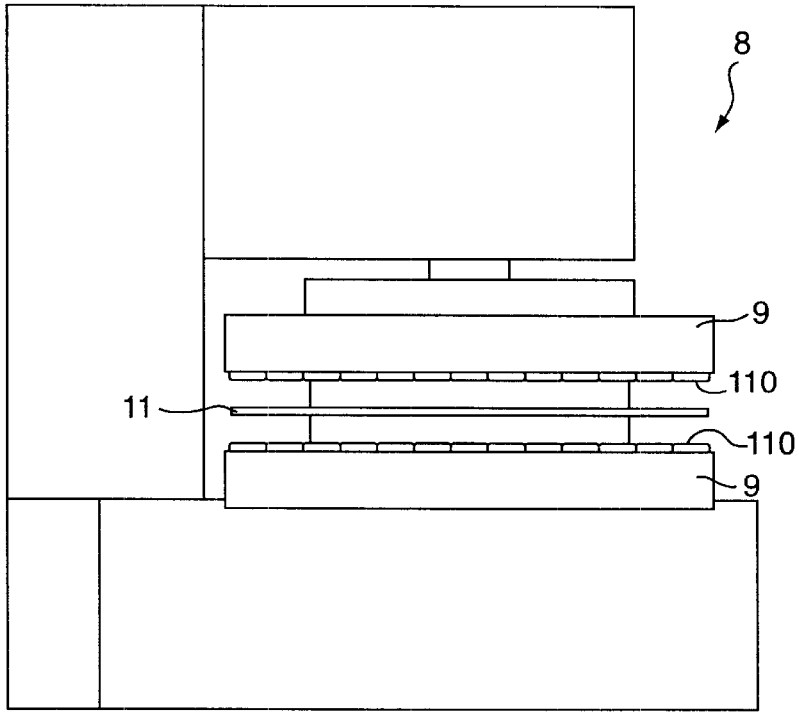
FIG. 1 is a simplified schematic view of a pad provided according to the present invention.

FIG. 1 is a simplified, schematic view of an embodiment of the present invention in the form of a rotatable pad 110 mounted on a cleaning/polishing machine 8. The polishing/cleaning machine 8 is of a known type and is used to planarize a wafer 11. The rotatable pad 110, as shown in FIG. 1, is installed on rotatable elements 9 of the cleaning/polishing apparatus 8. Buffing is performed by rotating the wager between an upper and lower platen, each fitted with a pad 110. The wafer is held in place laterally by capstan rollers (not shown) as it is vertically captured between the two pads 110. The capstan rollers rotate freely, while the rotating motion of the pads 110 under down force pressure rotates the wafer 11. The two pads 110 cover the edge of the wafer 11.

Figure 2:
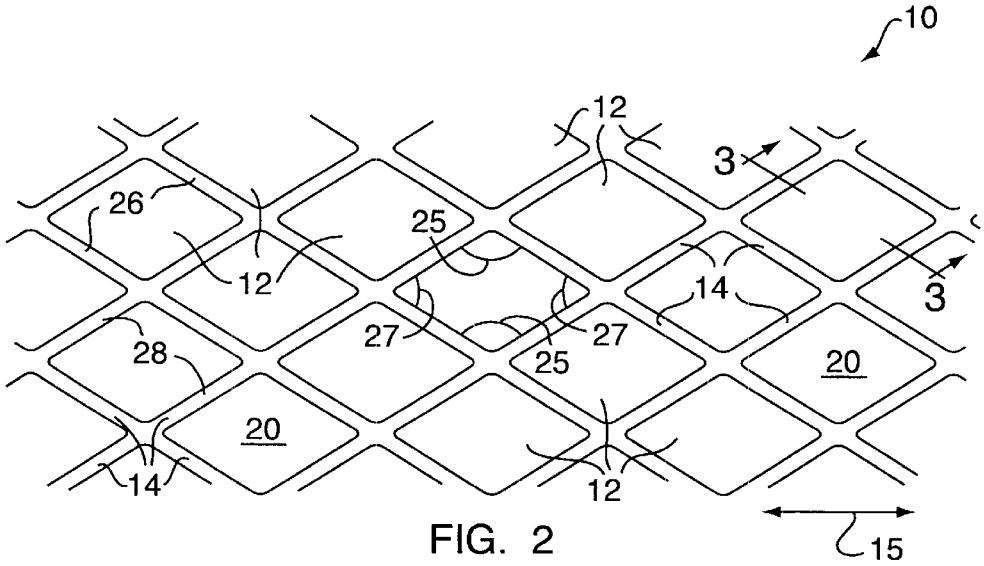
FIG. 2 is a schematic view of a surface of the pad according to the present invention showing a portion of a pattern of nubs formed in a pad surface.
Figure 3:
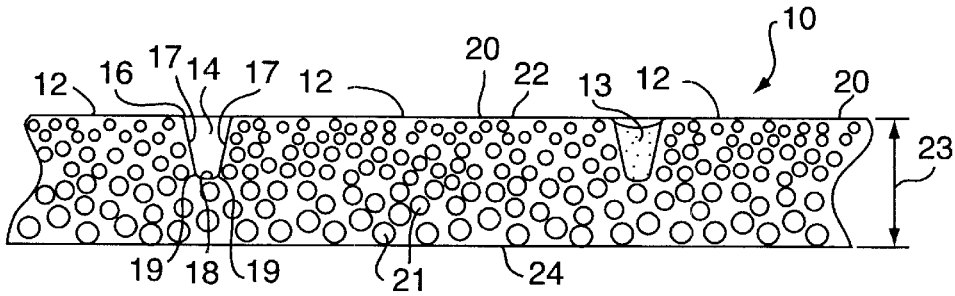
FIG. 3 is an elevational view of the pad of FIG. 1 showing a portion of the geometry of the nub surface pattern of FIG. 2.

Referring now to FIGS. 2 and 3, the pad 10 has a first surface 22, a second surface 24 opposite the first surface, and a thickness 26. The first surface 22 has a plurality of raised nubs 12 and a corresponding plurality of recessed troughs 14. The series of nubs 12 are arranged adjacent each other, as shown in FIG. 2, forming laterally alternating rows of nubs with the troughs interspersed between the adjacent nubs. Each nub 12 has a length and a width, wherein the length is greater than the width and a substantially diamond-shaped top 20 having a periphery and two major angles 25 disposed opposite each other widthwise and two minor angles 27 disposed opposite each other lengthwise wherein each angle is rounded so as to avoid sharp edges. A plurality of troughs 14 are interspersed between the adjacent nubs 12, and divided into a first group of substantially parallel troughs 26 and a second group of substantially parallel 28 troughs which first and second groups of parallel troughs 26 and 28 cross one another forming a hatch pattern. Each trough 14 has a bottom and two sides 17 flanking the bottom and extending upward to meet the tops of the nubs 12 adjacent each trough 14 forming an edge 16 along the periphery of the top 20 of each nub 12. Each trough 14 is about 2 mm deep, has a slightly rounded or concave bottom 18 having rounded corners 19 and measures about 1.56 mm wide. The edges 19 are sloped at an angle of 78 degrees. There are no sharp edges or corners on the first surface 22 of the entire pad 10.

The pad 10 is composed of a porous material, having very fine pores 21 on the order of 2–5 microns, such that the first and second surfaces 22 and 24 are in fluid communication. The size of the pores 21 follows a gradient from the first surface 22 to the second surface 24 such that smaller pores are adjacent the first surface 22 and larger pores adjacent the second surface 24 with pores of intermediate dimension interposed therebetween.

The pores 21 allow a consistent film of chemical cleaning fluids to flow on the first surface 22 of the pad 10 thereby establishing a film of consistent strength. This microporosity restricts large particles and thick residues from trapping in the surface of the brush to scratch the face of the wafer. The micropore surfaces of the pad 10 reduces loading, allows easy rinsing of larger particles from the film, and extends the service life of the pad 10. The uniform structure of the pores allows absorption of chemical cleaning fluid from external sources, and uniform low-to-high flow from internal sources of chemical cleaning fluid. In high flow rate applications, the open-cell structure of the pad 10 is augmented by an internal structure that allows higher volumes of chemical cleaning fluid to flow to critical points in the first surface 22.

Chemicals 13, such as polishing or cleaning chemicals, may be interposed within the troughs 14. For example, semiconductor grade zircon abrasive may be provided interspersed between the nubs 12 in the troughs 14 for use in the polishing step, as shown in FIG. 3. This characteristic allows the use of the same pad 10 for both polishing and cleaning in semiconductor applications. A pad 10 of the present invention is preferably comprised of or coated by a hybrid polyurethane as disclosed in a commonly owned, co-pending application entitled "Hydrophilic Polyurethane Foam", assigned to Berkshire Corporation, the contents of which are incorporated herein by reference in its entirety. Alternative compositions and coatings include polyvinyl hybrid and other hybrid polyurethanes. No silicon or chloride should be present in the polymer used. The pad 10 is in any case composed of a polymer which has high elasticity, tensile strength and softness so that contact with the pad 10 will conform to the features of the face of the wafer or other substrate without stress to the features on the face of the wafer. The elasticity and soft compression of the pad 10 is selected to allow constant contact with the face of the wafer without stress or degradation of the pad's first surface 22. Rapid release of compression draws chemical cleaning fluid from the face of the wafer to the surface of the pad and into the pad.

Figure 4A:
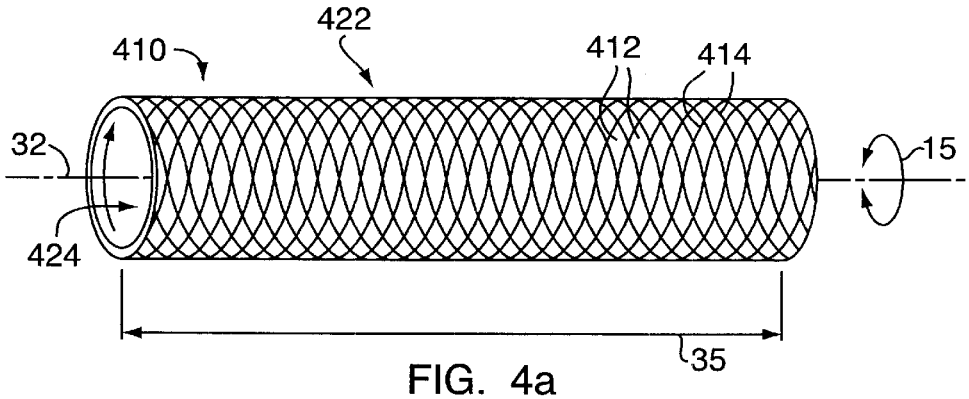
FIG. 4*a* is a schematic view of another pad provided in accordance with the present invention.
Figure 4B:
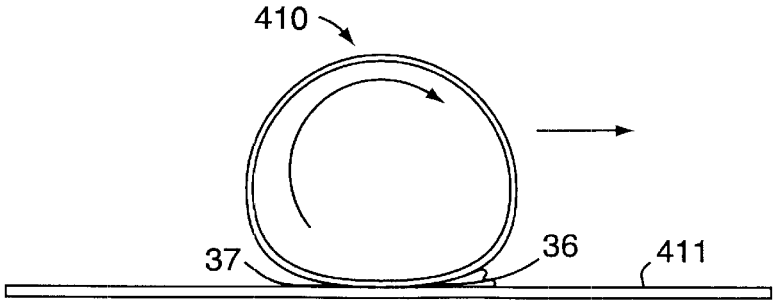
FIG. 4*b* is schematic side view of the pad of FIG. 4*b* in operation.

FIG. 4*a* shows a pad 410 formed in a cylinder to operate as a roller. The pad 410 has an inner cavity bound by inner surface 424 extending along a longitudinal pad axis 32. The pad 410 is characterized by an outer surface 422 which has pattern of raised nubs 412 and troughs 414 configured so that the nubs 412 have a length 35 substantially orthogonal to the longitudinal pad axis 32. In operation, the pad 410 is rolled across a face of a wafer. Cleaning/polishing chemicals are applied through the inner surface 424 and advances to the outer surface 422 of the pad 410 for presentation to the wafer face via the pores. The pad 410 is pressed against the face of the wafer 411 a select amount to ensure that the chemicals are able to access all the facial features of the wafer. The leading edge 36 of the wafer, as shown in FIG. 4*b*, is the source of the chemicals, as it receives the most pressure. Trailing pad edge 37 absorbs the spent chemistry, thereby leaving a clean substrate.

Figure 5:
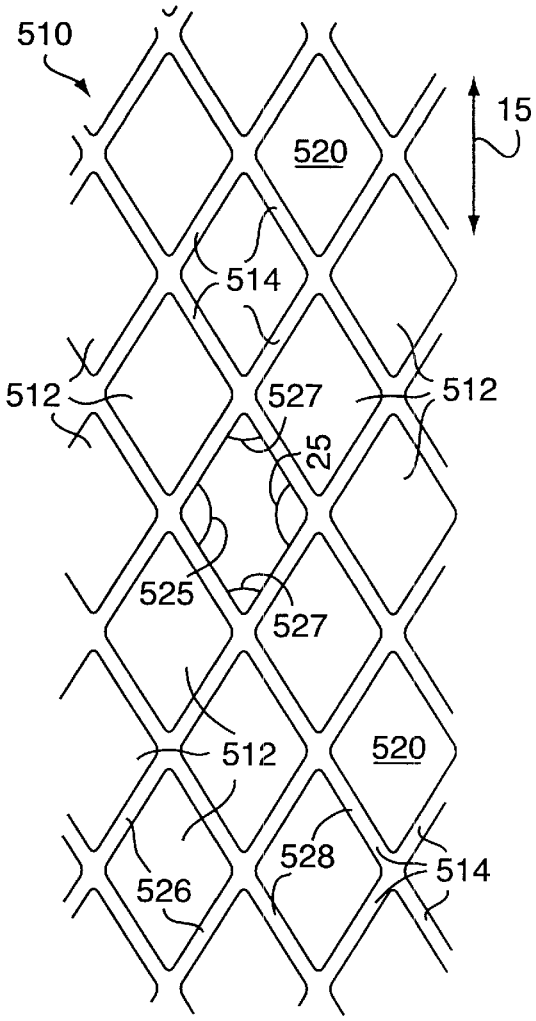
FIG. 5 is a schematic view of yet another pad provided in accordance with the present invention.

FIG. 5 shows a manually operated pad 510 used by hand. The manually operated pad 510 is moved across a substrate to clean the substrate. The direction of movement for cleaning/polishing is indicated by the arrow 15.

Figure 6:
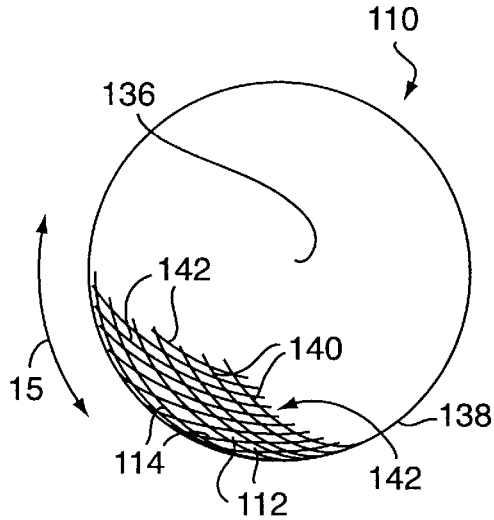
FIG. 6 is a schematic view of a selected portion of the pad surface of FIG. 1.

Another embodiment of the present invention is in the form of a rotatable pad 110 as shown in FIGS. 1 and 6. The first surface of the rotatable pad 124 has a plurality of nubs 112 and a plurality of troughs 114 disposed thereon wherein the nubs 112 are arranged adjacent each other forming laterally alternating concentric circles of nubs extending from a center region 136 of the pad 110 to a peripheral region 138 of the pad 110. The plurality of troughs 114 are interspersed between adjacent nubs 112, and divided into a first group of roughly parallel troughs 140 and a second group of roughly parallel troughs 142 wherein the troughs of the first and second groups 140 and 142 are arranged at an angle to one another forming a concentric hatch pattern. The numeral 15, as in each of the drawings, indicates the lengthwise direction of the nubs 112 and the direction of movement of the cleaning pad 110 relative to a substrate.

Figure 7:
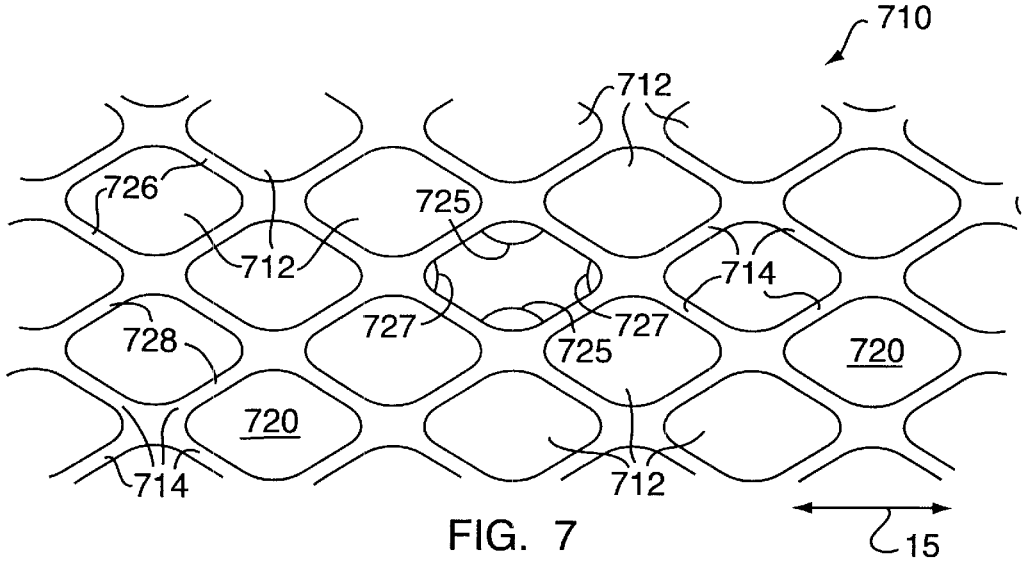
FIG. 7 is a top schematic view of another embodiment of a pad provided according to the present invention having a modified nub surface pattern.

FIG. 7 shows an alternate embodiment of the pad 710 having a plurality of raised, substantially boat- or hull-shaped nubs 712 and a plurality of troughs 714 wherein the nubs 712 are arranged adjacent each other forming laterally alternating rows of nubs. Each nub 712 has a length and a width, wherein the length is greater than the width. Also, each substantially diamond-shaped top has two rounded opposing sides running lengthwise so that each nub has a substantially hull shape. As with the embodiment depicted in FIG. 2, each nub 712 is raised above the first surface forming a diamond shaped top 720 having rounded edges. The edges are sloped at an angel of 78 degrees, as discussed above. A plurality of troughs 714 are interspersed between adjacent substantially nubs, and divided into a first group 726 of substantially parallel troughs and a second group 728 of substantially parallel troughs. The first and second group of troughs are arranged at an angle to one another forming a hatch pattern. There are no sharp edges or corners in the pad.

Pads composed of different polymers result in slightly different dimensions. Pads composed of polyvinyl hybrids such as BPTM186P (tradename) from the HYDROFERA™ Company (Willimantic, Conn.) have the following characteristics. The diamond-shaped top of the nubs on the first surface of a polyvinyl hybrid pad (BPTM186P) is about 13 mm wide by 21 mm long. At 12% saturation, the repeat of the diamond-shapes are 15 mm by 30 mm. A fully saturated pad has diamond-shaped top which is 16 mm wide by 23 mm long, and the repeat of the diamond-shapes are 17 mm by 32 mm. The dimensions of a dry hybrid polyurethane pad is about 13 mm wide by 21 mm long, and 17 mm wide by 28 mm long wet. The repeats for a hybrid polyurethane pad is 15 mm wide by 30 mm long dry and 20 mm wide by 40 mm long wet. The bottom 18 of the trough 14 is 2 mm beneath the top 20.

A vacuum may be applied across the second surface to remove cleaning chemicals and moistures continuously in spin drying applications. The flow rate is reversed via the vacuum supplied across the second surface. The micropore first surface of the pad captures the remaining microparticles, and the shallow hatch pattern channels larger particles to the grooves for capture in the larger port pores.

An example of a process which utilizes the pad in a brush form, attached to cleaning/polishing machinery, involves a supplemental spin wash/dry processing. This process for post-chemical mechanical processing and clean-in/dry-out spin drying is set out hereinafter. At less than 78 rounds per minute, a wafer is spun under a jet aimed at an angle to the center of the face of the wafer from a first nozzle and slightly outward toward the edge of the wafer. The jet is a solution of steam and solvent vapor in a gas that lifts particles and residues. An upward air flow in the spin chamber allows the microparticles to be drawn out of the chamber and away from the face of the wafer. Cycle time is approximately 20–30 seconds. A roller according to the present invention is disposed on a vacuum fed mandrel contacts the face of the wafer to withdraw residual moisture and microparticles to levels detectable by test at 0.08 microns. Cycle time is approximately 6 to 15 seconds. Then the rounds per minute is increased to 1200 to 2000, and a heated, inert gas is sent through a second nozzle parallel to the first nozzle. The gas further releases the microparticles and drives them into the upward air stream. Cycle time is approximately 6 to 20 seconds depending on the depth of the pattern on the wafer.

The patterned first surface of the pad in the roller form of this example creates hydroplaning turbulence in the cleaning chemicals. Movement in line, or in a circle, along the direction indicated at 15, in the drawings, produces turbulence. A fine layer of cleaning chemicals is provided on/in the patterned first surface of the brush. The cleaning chemicals are transferred onto and into the face of the wafer for complete saturation of the wafer circuit pattern. Sufficient amounts of cleaning chemicals are utilized such that a constant amount of cleaning chemical fluid is supplied on the external first surface of the roller. The roller then hydroplanes over the liquid, pushing the liquid over and into the face of the wafer. Turbulence created by the roller causes the cleaning chemicals to flush the sub-face features of the wafer and leave the face and sub-face truly clean. The troughs create a wake and subsequent turbulence in the film created by the cleaning chemical on the first surface of the pad, and into the face of the wafer. The troughs channel the debris, particles and residues away from the nubs to allow a constantly clean film hydroplaning on and into the face of the wafer. The turbulence forces the slurry residual and contaminants to the face of the wafer. The troughs allow the residual and contaminants to be collected and channeled away during the rinsing done during each brush revolution.

Use of the pad of the present invention may involve compressing the pad to dispel the cleaning chemicals therefrom onto a substrate for cleaning, creating turbulence in the cleaning chemicals dispelled on the substrate by moving the first surface lengthwise relative to the substrate, and removing the chemicals and debris by decompressing the pad to wick the cleaning chemicals and suspended debris into the first surface of the pad. Alternatively, as mentioned hereinabove, a vacuum may be applied across the second surface to pull the chemicals and debris into the pad. A roller may be used with these steps wherein the roller is provided on a mandrel, as is well known in the art, having cleaning chemicals dispersed within the pad or dispersed through the pad from the mandrel. The cleaning chemicals are dispelled from a leading edge of the roller when the roller is compressed onto the face of the substrate to be cleaned, the cleaning chemicals are subsequently removed at the trailing edge of the roller as the pad is decompressed, and agitation is achieved therebetween. In this manner, these cleaning steps are carried out concurrently.

It is to be understood that the present invention is not limited to the embodiments described above, but encompasses any and all embodiments within the scope of the following claims.

What is claimed is:

1. A pad for use in a clean room environment, the pad having:

a first surface, a second surface opposite the first surface, and a thickness;

the first surface having a plurality of raised nubs and a plurality of recessed troughs wherein the nubs are arranged adjacent each other forming laterally alternating rows with the troughs interspersed between the adjacent nubs and divided into a first group of substantially parallel troughs and a second group of substantially parallel troughs which first and second groups of parallel troughs cross one another forming a hatch pattern;

each nub has a length and a width wherein the length is greater than the width, and a substantially diamond-shaped top having a periphery and two major angles disposed opposite each other widthwise and two minor angles disposed opposite each other lengthwise wherein each angle is rounded; and each trough has a bottom and two sides flanking the bottom and extending upward to meet the tops of the nubs adjacent each trough forming an edge along the periphery of the top of each nub.

2. The pad of claim 1, wherein the troughs have concave bottoms.

3. The pad of claim 1, further comprising chemicals interposed within the troughs wherein the chemicals are taken from the group consisting of polishing chemicals and cleaning chemicals.

4. The pad of claim 1, wherein the pad is formed to make a roller having the nubs arranged such that the length of the nubs are orthogonal to a longitudinal axis of the roller.

5. The pad of claim 1 wherein the pad is composed of a porous material such that the first and second sides are in fluid communication.

6. The pad of claim 5 wherein the porous material has micropores in the range about 2 to about 5 microns.

7. The pad of claim 5 wherein the size of the pores follows a gradient from the first surface to the second surface such that smaller pores are adjacent the first surface and larger pores adjacent the second surface with pores of intermediate dimension interposed therebetween.

8. The pad of claim 1 wherein the bottom of the troughs are 2 mm beneath the tops of the nubs.

9. The pad of claim 1 wherein the length is from about 21 mm to about 40 mm and the width is from about 13 mm to about 20 mm.

10. The pad of claim 1 wherein the pad comprises a polymer taken from the group consisting essentially of hybrid polyurethane, and polyvinyl hybrids.

11. The pad of claim 1 wherein the two major angles are rounded to form a substantially boat-shaped nub.

* * * * *